US008353690B2

(12) United States Patent
Hogan et al.

(10) Patent No.: US 8,353,690 B2
(45) Date of Patent: Jan. 15, 2013

(54) QUAD CHAMBER MIXING PUMP

(75) Inventors: Tim P. Hogan, Bristol, WI (US); James R. Cleveland, Wheaton, IL (US); John Hsing, Chicago, IL (US); Jerry Visak, Vancouver, WA (US); Stephen Burns, Portland, OR (US); Charles F. Carr, Battle Ground, WA (US)

(73) Assignee: Fluid Management Operations LCC, Wheeling, IL (US)

( * ) Notice: Subject to any disclaimer, the term of this patent is extended or adjusted under 35 U.S.C. 154(b) by 357 days.

(21) Appl. No.: 12/704,938

(22) Filed: Feb. 12, 2010

(65) Prior Publication Data

US 2010/0143161 A1 Jun. 10, 2010

Related U.S. Application Data

(63) Continuation-in-part of application No. 11/833,040, filed on Aug. 2, 2007, now Pat. No. 7,946,832, which is a continuation-in-part of application No. 11/359,051, filed on Feb. 22, 2006, now Pat. No. 7,648,349.

(51) Int. Cl.
*F04B 7/06* (2006.01)

(52) U.S. Cl. ..... 417/500; 417/53; 417/492; 417/521

(58) Field of Classification Search ..... 417/53, 417/62, 250, 326, 329, 403, 415, 500, 492, 417/486, 534, 535, 521; 91/61
See application file for complete search history.

(56) References Cited

U.S. PATENT DOCUMENTS

| | | | | |
|---|---|---|---|---|
| 5,482,448 | A * | 1/1996 | Atwater et al. | 417/492 |
| 2002/0197164 | A1 * | 12/2002 | Hogan et al. | 417/20 |
| 2004/0187677 | A1 * | 9/2004 | Moradmand et al. | 92/72 |

* cited by examiner

*Primary Examiner* — Devon Kramer
*Assistant Examiner* — Ryan Gatzemeyer
(74) *Attorney, Agent, or Firm* — Miller, Matthias & Hull LLP

(57) ABSTRACT

A pair of dual chamber mixing pumps are combined which allow for a constant dispense rate profile using motor speed modulation. Each pump is divided into two chambers, the proximal chamber and the distal chamber. The chambers are defined in part by a piston having proximal and distal ends and recessed sections. The pump utilizes one common driving mechanism to axially rotate and laterally reciprocate the piston to provide continuous pumping of fluids with reduced pulsations. Each fluid enters through its own pump inlet and outlet. The pumps are operated 90° out of phase with respect to each other.

14 Claims, 19 Drawing Sheets

Normalized Flow, .500" Diameter Piston. Standard Pump
800 RPM Fixed Flowrate
Normalized Flowrate
900
800
700
600
500
400
300
200
100
0
-100
-200
-300
-400
-500
-600
-700
-800
-900
-1000
0.000000
0.020000
0.040000
0.060000
0.080000
0.100000
Time (seconds)
DISPENSE
FILL
1
2

HSP Dual Pump, Output From Pump 1 At 600 RPM Steady

HSP Dual Pump, Output From Pump 2 At 600 RPM Steady
Pump 2 Lags Pump1 By 90 Degrees Rotation HSP Dual Pump, Combined Putput At Pulse-Reduced Speed
(Totally Steady Flow At Outlet)
Normalized Flowrate
900
800
700
600
500
400
300
200
100
0
-100
-200
-300
-400
-500
-600
-700
-800
-900
-1000
0.000000
0.020000
0.040000
0.060000
0.080000
0.100000
0.120000
0.140000
Time (seconds)
218
217
219

QUAD CHAMBER MIXING PUMP

CROSS-REFERENCE TO RELATED APPLICATIONS

This is a continuation-in-part of U.S. patent application Ser. No. 11/833,040 filed on Aug. 2, 2007, still pending, which is a continuation-in-part of U.S. patent application Ser. No. 11/359,051 filed on Feb. 22, 2006, still pending.

BACKGROUND

1. Technical Field

Improved pumps are disclosed with two nutating pumps driven by the same motor and 90° out of phase. Each nutating pump is a dual chamber pump for simultaneously pumping and optionally mixing two fluids. The two chambers each pump 180° out of phase. By employing two dual chamber pumps 90° out of phase, all four chambers are 90° out of phase for continuous dispensing. Different fluids may be pumped independently in each chamber. The proportion of each fluid pumped is proportional to the annular area of the piston end which pumps that fluid. A desired proportion or ratio between multiple fluids may be achieved by varying the surface areas of the piston ends.

2. Description of the Related Art

Nutating pumps are pumps having a piston that both rotates about its axis liner and contemporaneously slides axially and reciprocally within a line or casing. The combined 360° rotation and reciprocating axial movement of the piston produces a sinusoidal dispense profile that is illustrated in FIG. 1. The line 1 graphically illustrates the flow rate at varying points during one revolution of the piston. The portion of the curve 1 above the horizontal line 2 representing a zero flow rate represents the output while the portion of the curve 1 disposed below the line 2 represents the intake or "fill."

Existing nutating pumps can be operated by rotating the piston through a full 360° rotation and corresponding axial travel of the piston. Such piston operation results in a specific amount of fluid pumped by the nutating pump with each revolution of the piston. Accordingly, the amount of fluid pumped for any given nutating pump is limited to multiples of the specific volume. If a smaller volume of fluid is desired, then a smaller sized nutating pump is used or manual calibration adjustments are made to the pump.

To avoid running the motor of a small pump at high speeds to dispense larger volumes or running the motor of a large pump at slow or minimum speeds for smaller volumes, stepper motors have been used with nutating pumps to provide a partial revolution dispense. While, using a partial revolution to accurately dispense fluid from a nutating pump is difficult due to the non-linear output of the nutating pump dispense profile, controllers, software algorithms and sensors can be used to monitor the angular position of the piston, and using this position, calculate the number of steps required to achieve the desired output. See, e.g., U.S. Pat. No. 6,749,402.

The sinusoidal profile illustrated in FIG. 1 is based upon a pump operating at a constant motor speed. While operating the pump at a constant motor speed has its benefits in terms of simplicity of controller design and pump operation, the use of a constant motor speed also has inherent disadvantages, some of which are addressed in U.S. Pat. No. 6,749,402.

Specifically, in certain applications, the maximum output flow rate illustrated on the left side of FIG. 1 can be disadvantageous because the output fluid may splash or splatter as it is being pumped into the output receptacle at the higher flow rates. For example, in paint or cosmetics dispensing applications, any splashing of the colorant as it is being pumped into the output container results in an inaccurate amount of colorant being deposited in the container but also colorant being splashed on the colorant machine which requires labor intensive clean-up and maintenance Obviously, this splashing problem will adversely affect any nutating pump application where precise amounts of output fluid are being delivered to an output receptacle that is either full or partially full of liquid or small output receiving receptacles.

For example, the operation of a conventional nutating pump having the profile of FIG. 1 results in pulsed output flow as shown in FIGS. 2 and 3. The pulsed flow shown at the left in FIGS. 2 and 3, at speeds of 800 and 600 rpm respectively, results in pulsations 3 and 4 which are a cause of unwanted splashing. FIGS. 2 and 3 are renderings of actual digital photographs of an actual nutating pump in operation. While reducing the motor speed from 800 to 600 rpm results in a smaller pulse 4, the reduction in pulse size is minimal and the benefits are offset by the slower operation. To avoid splashing altogether, the motor speed would have to be reduced substantially more than 20% thereby making the choice of a nutating pump less attractive despite its high accuracy. A further disadvantage to the sinusoidal profile of FIG. 1 is an accompanying pressure spike that causes an increase in motor torque.

In addition to the splashing problem of FIG. 1, the large pressure drop that occurs within the pump as the piston rotates from the point where the dispense rate is at a maximum to the point where the intake rate is at a maximum (i.e. the peak of the curve shown at the left of FIG. 1 to the valley of the curve shown towards the right of FIG. 1) can result in motor stalling for those systems where the motor is operated at a constant speed. As a result, motor stalling will result in an inconsistent or non-constant motor speed, there by affecting the sinusoidal dispense rate profile illustrated in FIG. 1, and consequently, would affect any control system or control method based upon a preprogrammed sinusoidal dispense profile. The stalling problem will occur on the intake side of FIG. 1 as well as the pump goes from the maximum intake flow rate to the maximum dispense flow rate.

The splashing and stalling problems addressed in U.S. Pat. No. 6,749,402 are illustrated partly in FIG. 4 which shows a modified dispense profile 1*a* where the motor speed is varied during the pump cycle to flatten the curve 1 of FIG. 1. The variance in motor speed results in a reduction of the peak output flow rate while maintaining a suitable average flow rate by (i) increasing the flow rates at the beginning and the end of the dispense portion of the cycle, (ii) reducing the peak dispense flow rate, (iii) increasing the duration of the dispense portion of the cycle and (iv) reducing the duration of the intake or fill portion of the cycle. This is accomplished using a computer algorithm that controls the speed of the motor during the cycle thereby increasing or decreasing the motor speed as necessary to achieve a dispense curve like that shown in FIG. 4.

However, the nutating pump design of U.S. Pat. No. 6,749,402 as shown in FIG. 4, while reducing splashing, still results in a start/stop dispense profile and therefore the dispense is not a pulsation-free or completely smooth flow. Despite the decrease in peak dispense rate, the abrupt increase in dispense rate shown at the left of FIG. 4 and the abrupt drop off in flow rate shown at the center of FIG. 4 still provides for the possibility of some splashing. Further, the abrupt starting and stopping of dispensing followed by a significant lag time during the fill portion of the cycle still presents the problems of significant pressure spikes and bulges and gaps in the fluid stream exiting the dispense nozzle. Any decrease in the slope of the portions of the curves shown at 1*a*, 1*c* would require an increase in the cycle time as would any decrease in the maximum fill rate. Thus, the only modifications that can be made to the cycle shown in FIG. 4 to reduce the abruptness of the start and finish of the dispensing portion of the cycle would result in increasing the cycle time and any reduction in the maximum fill rate to reduce pressure spiking and motor stalling problems would also result in an increase in the cycle time.

Accordingly, there is a need for an improved nutating pump, also adapted for mixing and having multiple pump chambers, with improved control and/or a method of control thereof whereby the pump motor is controlled so as to reduce the likelihood of splashing and "pulsing" during dispense without compromising pump speed and accuracy.

SUMMARY OF THE DISCLOSURE

In satisfaction of the aforenoted needs, a quad chamber pump is disclosed which includes dual nutating pumps, each with two pump chambers for delivering identical fluids or mixing two fluids at a main output. Each nutating pump includes dual chambers for a total of four chambers overall in this embodiment. The two pumps are 90° out of phase. The output from the two chambers of each pump is about 180° out of phase. As a result, a chamber of one pump is about 90° out of phase from two pump chambers of the other pump and 180° out of phase with the other chamber of its pump. As a result, four pump chambers are only 90° out of phase from each other which provide unique opportunities for modulating flow.

Two like pumps can be driven by a single motor. In one embodiment, the motor is disposed between the two like pumps with a motor drive shaft including two ends extending in opposite directions and end being coupled to a piston of one of the pumps.

For each pump, the two pump chambers may be defined by the housing and the piston. Specifically, a proximal chamber may be defined by the proximal recessed section and the proximal end of the pump section and the housing. A distal chamber may be defined by the distal recessed section and the distal end of the pump section and the housing. The two chambers are axially isolated from each other by the middle seal and the pump section of the piston. By running two like or similar pumps off of the same motor, four pump chambers may be created.

In another refinement, the pump comprises a controller operatively coupled to the motor. The controller generates a plurality of output signals including at least one signal to vary the speed of the motor.

In another refinement, the diameter of the proximal sections of the pistons is varied to adjust the annular areas of the proximal ends of the pistons. The varied annular areas thus vary the proportional outputs of the proximal chambers of each pump.

In another refinement, a passageway connects the outlets of the two pumps leading to a mixing chamber for mixing two fluids.

In a refinement, three or more dual chamber mixing pumps are used out of phase from each other.

Other advantages and features will be apparent from the following detailed description when read in conjunction with the attached drawings.

BRIEF DESCRIPTION OF THE DRAWINGS

The disclosed embodiments are illustrated more or less diagrammatically in the accompanying drawings, wherein.

Figure 1:
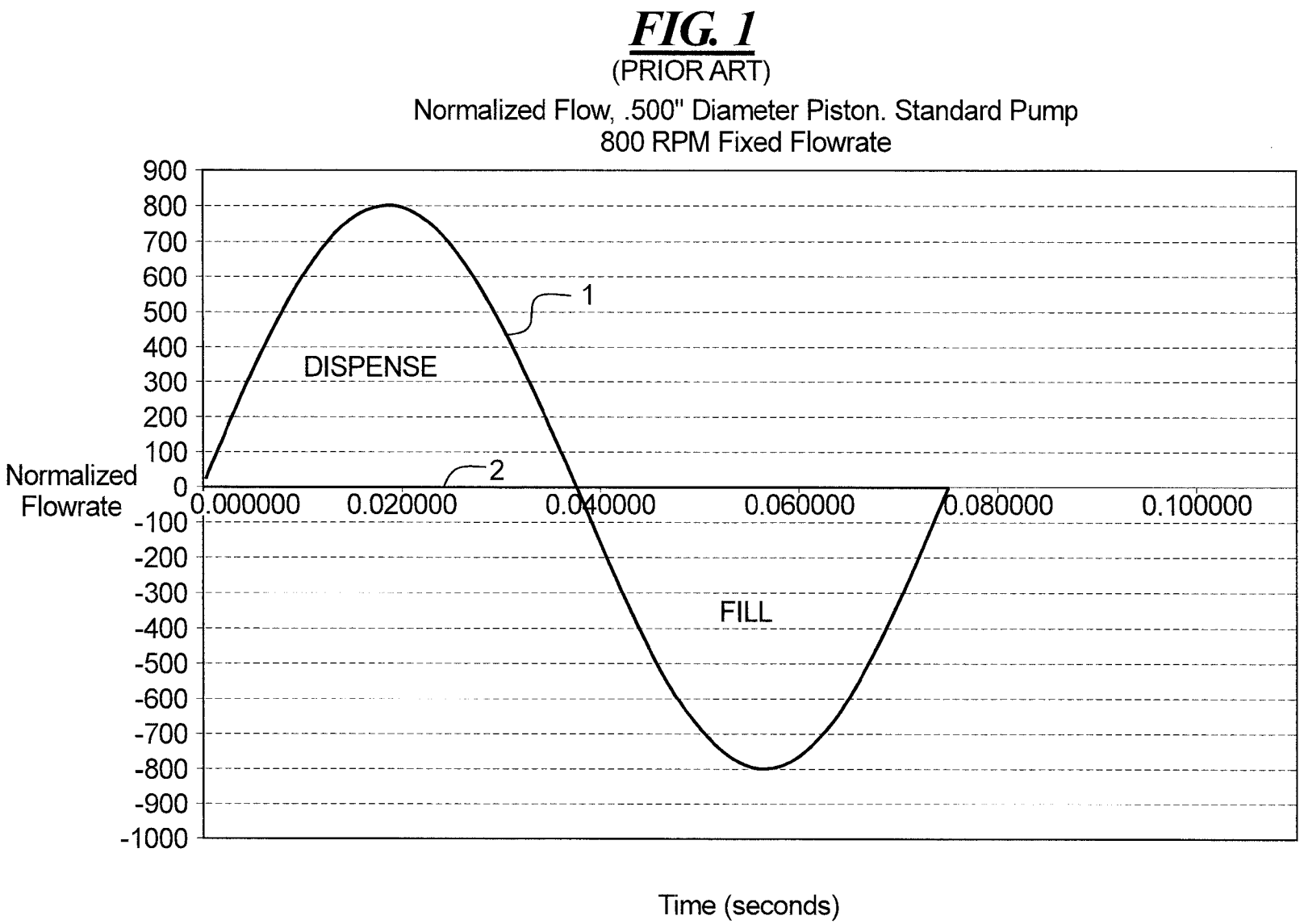
FIG. 1 (PRIOR ART)
FIG. 1 illustrates, graphically, a prior art dispense/fill profile for a prior art nutating pump operated at a fixed motor speed.

It will be noted that the drawings are not necessarily to scale and that the disclosed embodiments are sometimes illustrated by graphic symbols, phantom lines, diagrammatic representations and fragmentary views. In certain instances, details may have been omitted which are not necessary for an understanding of the disclosed embodiments or which render other details difficult to perceive. It should be understood, of course, that this disclosure is not limited to the particular embodiments illustrated herein.

DETAILED DESCRIPTION OF THE PRESENTLY PREFERRED EMBODIMENTS

Turning to FIGS. 5-8, a nutating pump 20 is shown. The pump 20 includes a rotating and reciprocating piston that is disposed within a pump housing 21. The pump housing 21, in the embodiment illustrated in FIGS. 5-6 also includes an end cap or head 22. The housing or casing 21 may also be coupled to an intermediate housing 23 used primarily to house the coupling 24 that connects the piston 10 to the drive shaft 25 which, in turn, is coupled to the motor shown schematically at 26. The coupling 24 is coupled to the proximal end 26 of the piston 10 by a link 27. A proximal section 28 of the piston 10 has a first maximum outer diameter that is substantially less than the second maximum outer diameter of the larger pump section 29 of the piston 10. The purpose of the larger maximum outer diameter of the pump section 29 will be explained in greater detail below. The proximal section 28 is coupled to the pump section 29 by a beveled transition section 31. The transition section 31 shown in FIGS. 5-8 is slanted or beveled but a vertical transition section may be employed as well.

Returning to FIGS. 5-8, the pump section 29 of the piston 10 passes through a middle seal 32. The distal end 33 of the pump section 29 of the piston 10 is also received in a distal seal 34. A fluid inlet is shown at 35 and a fluid outlet is shown at 36. The proximal section 28 of the piston passes through a proximal seal 38 disposed within the seal housing 39.

Figure 5:
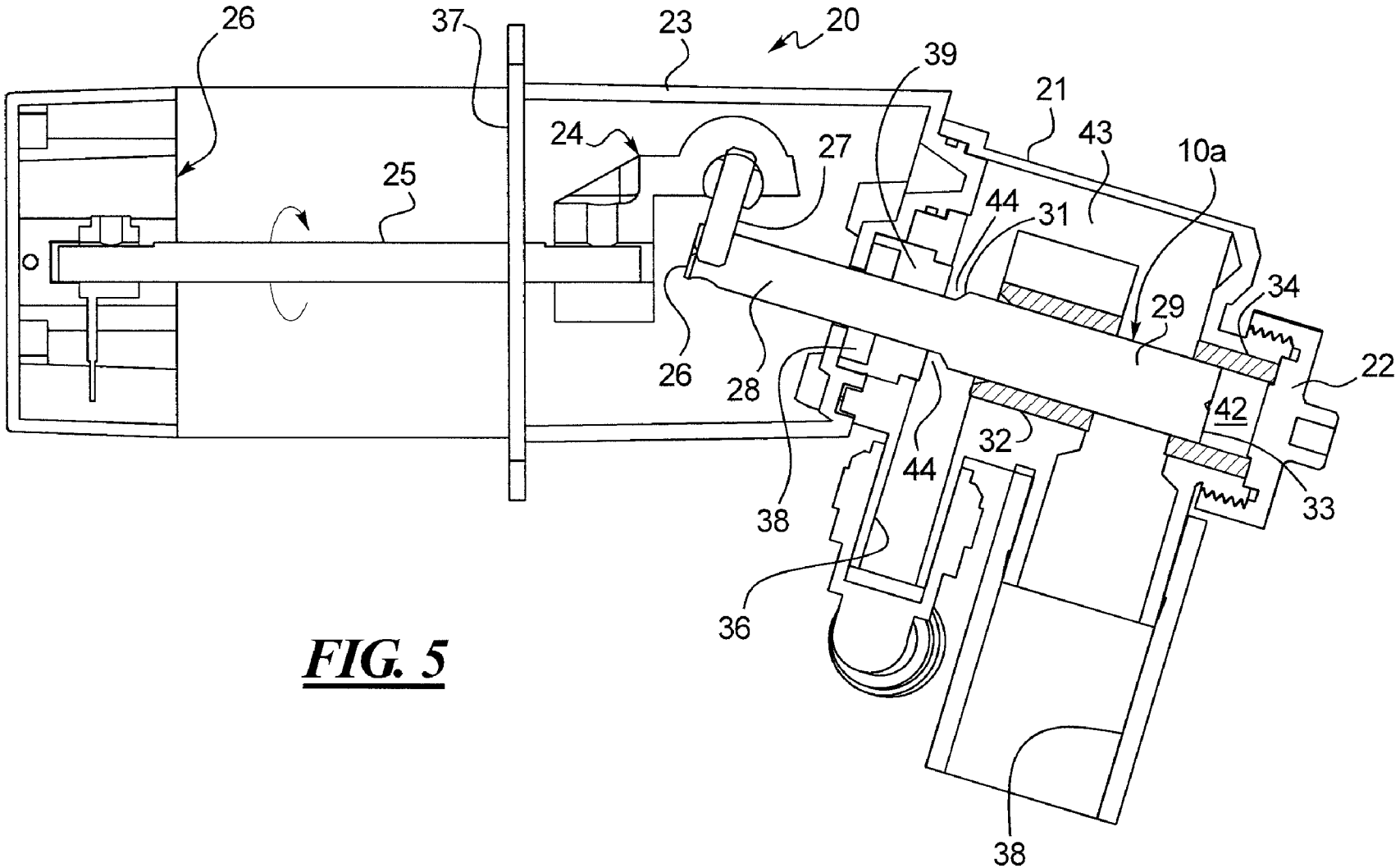
FIG. 5 is a sectional view of a disclosed nutating pump showing the piston at the "bottom" of its stroke with the stepped transition between the smaller proximal section of the piston and the larger pumping section of the piston disposed within the "second" chamber and with the distal end of the piston being spaced apart from the housing or end cap thereby clearly illustrating the "first" pump chamber.
Figure 6:
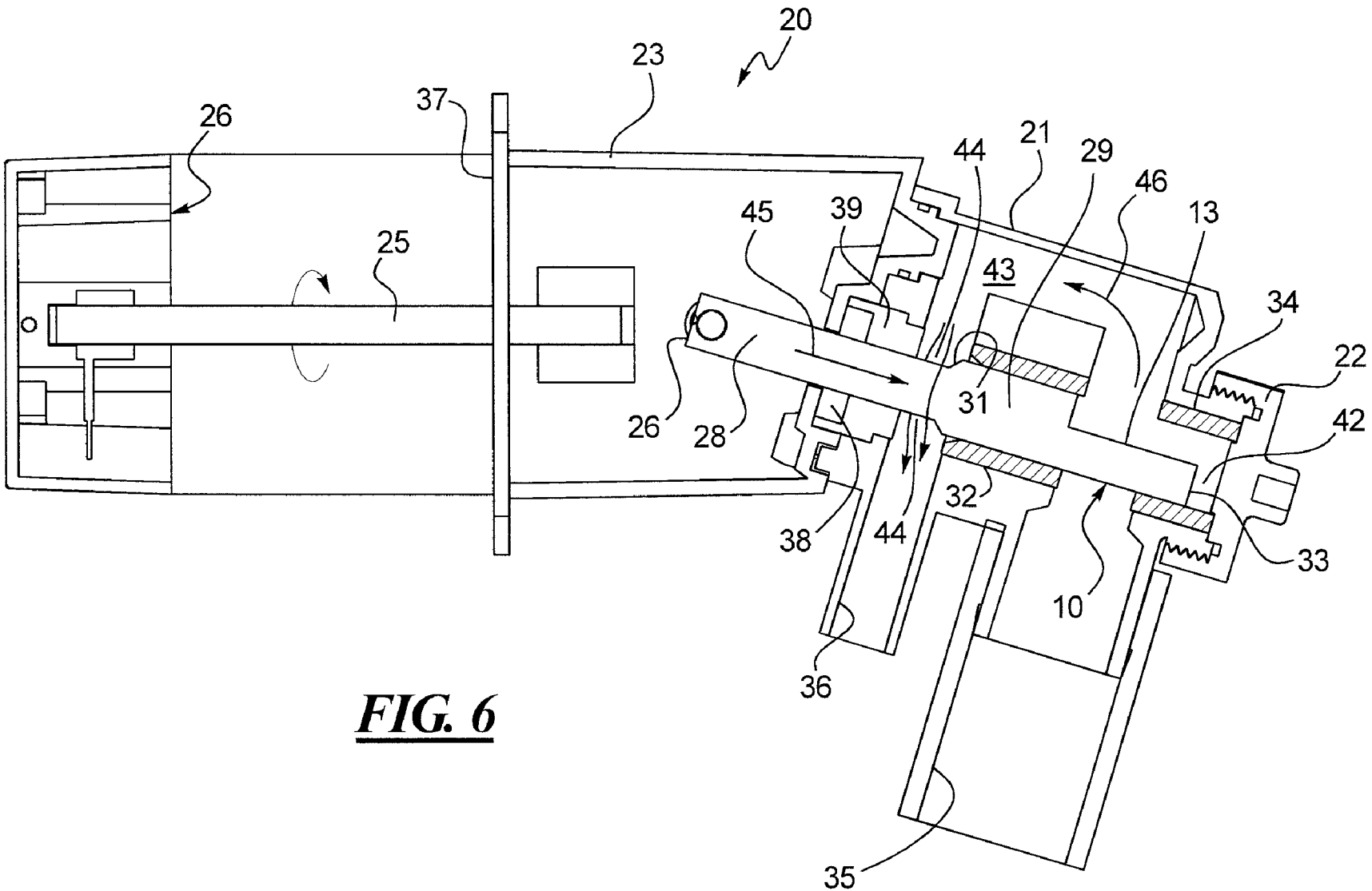
FIG. 6 is another sectional view of the pump shown in FIG. 5 but with the piston having been rotated and moved forward to the middle of its upstroke and clearly illustrating fluid leaving the first chamber and passing through the second chamber.
Figure 7:
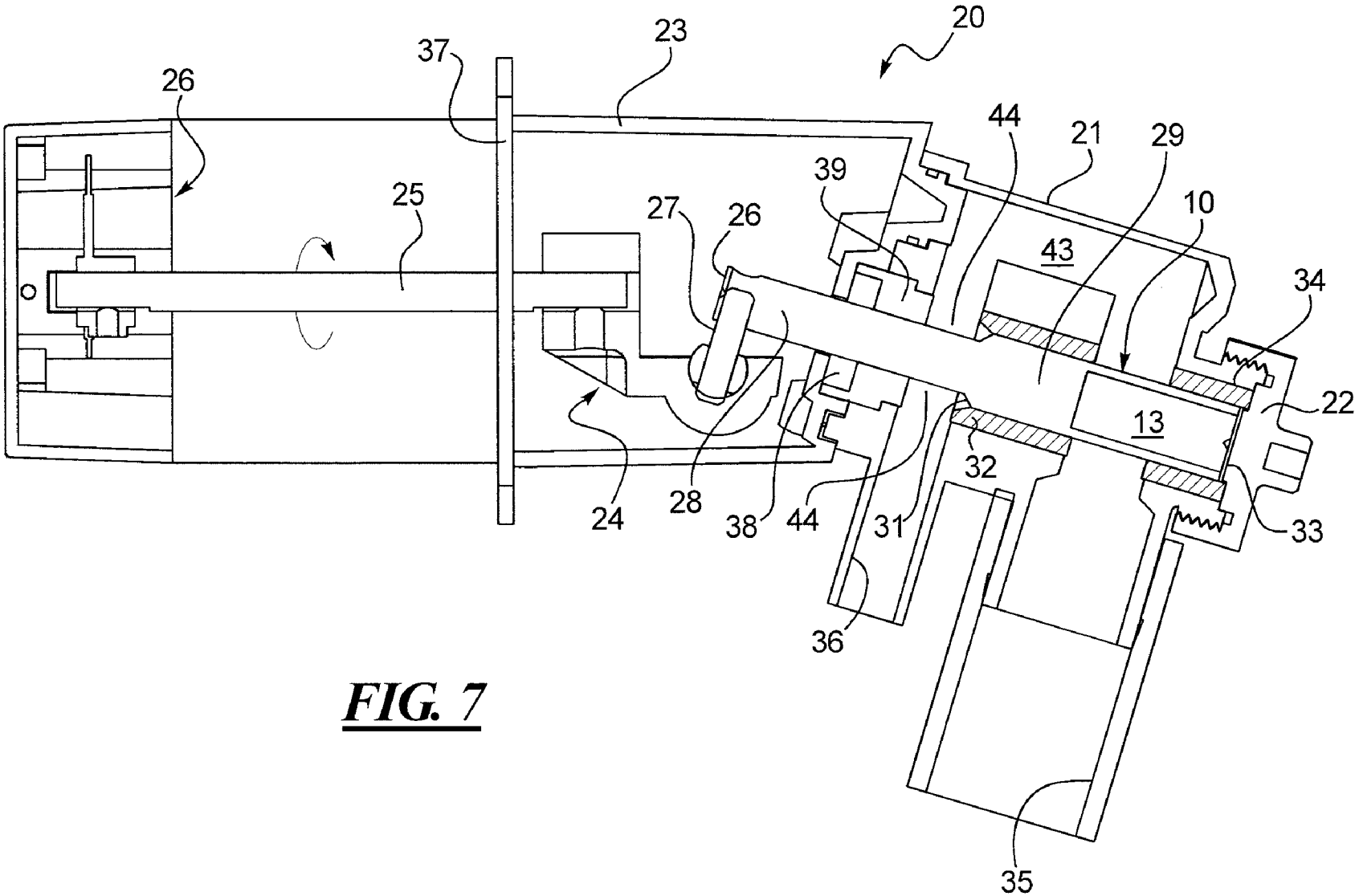
FIG. 7 is another sectional view of the pump illustrated in FIGS. 5 and 6 but with the piston rotated and moved towards the head or end cap at the top of the piston stroke with the narrow proximal portion of the piston (i.e., the narrow portion connected to the coupling) disposed in the second chamber and with the wider pump section of the piston disposed in the middle seal that separates the second from the first pump chambers.
Figure 8:
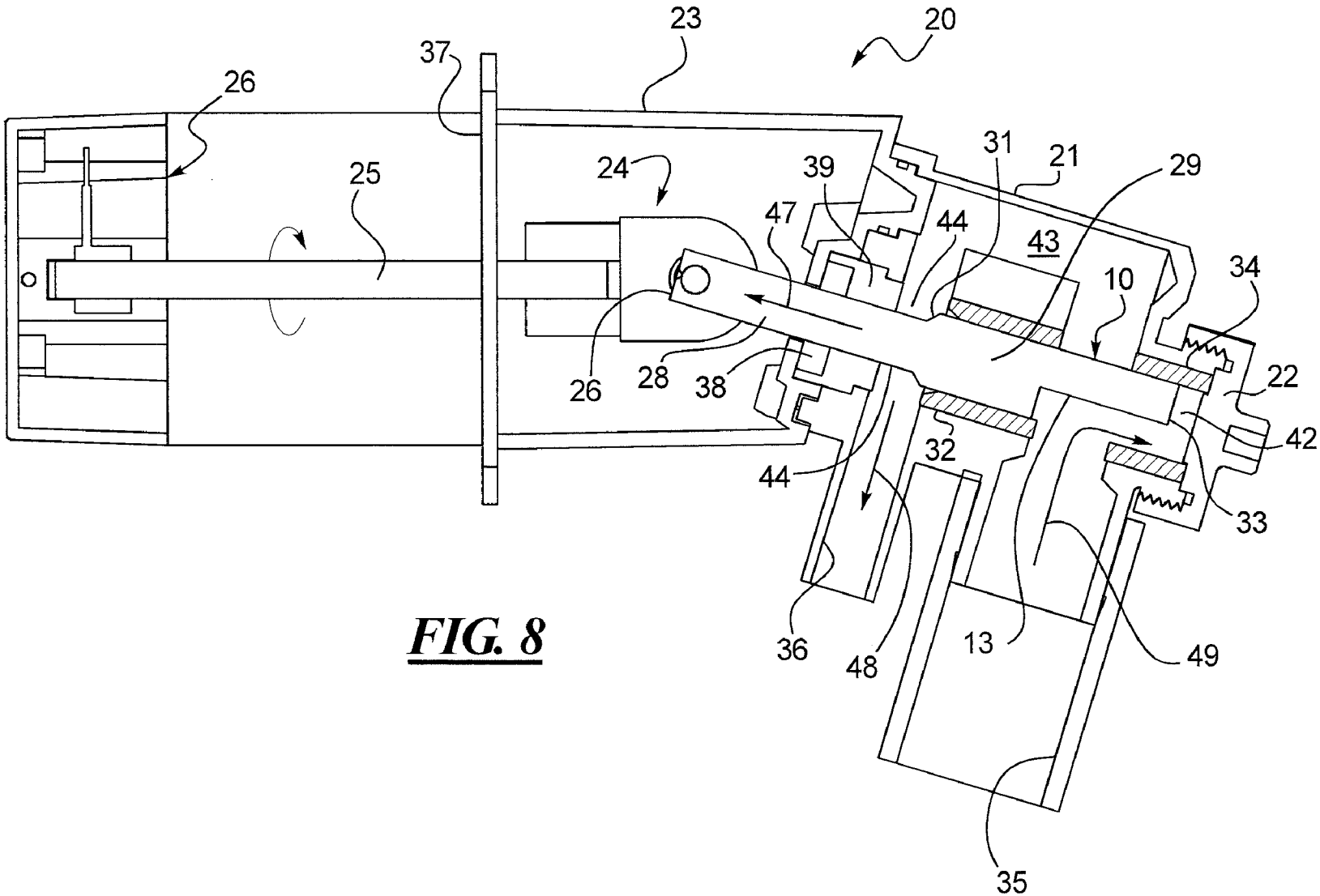
FIG. 8 is another sectional view of the pump illustrated in FIGS. 5-7 but with the piston rotated again and moved away from the housing end cap as the piston is moved to the middle of its downstroke, and illustrating fluid entering the first chamber and exiting the second chamber.

The first pump chamber is shown at 42 in FIGS. 5, 6 and 8 and is blocked from view in FIG. 7 as the first chamber 42 is covered by the piston 10 in FIG. 7. Generally speaking, the first chamber 42 is not a chamber per se but is an area where fluid is primarily displaced by the axial movement of the piston 10 from the position shown in FIG. 5 to the right to the position shown in FIG. 7 as well as the rotation of the piston and the engagement of fluid disposed in the first chamber or area 42 by the machined flat area shown at 13 in FIGS. 6-8. The machined flat area 13 is hidden from view in FIG. 5. A conduit or passageway shown generally at 43 connects the first chamber 42 to the second chamber or area 44. The distance between the outer diameters of the proximal section 28 and larger pump section 29 of the piston 10 generates displacement through the second chamber or area 44.

Still referring to FIG. 5, the piston 10 is shown at the "bottom" of its stroke. The transition or step 31 is disposed well within the second chamber 44 and the distal end 33 of the pump section 29 of the piston 10 is spaced apart from the head 22. Fluid is disposed within the first chamber 42. The first chamber 42 is considered to be bound by the flat or machined portion 13 of the piston 10, the distal end 33 of the pump section 29 of the piston 10 and the surrounding housing elements which, in this case, are the distal seal 34 and head 22. It is the pocket shown at 42 in FIG. 3 where fluid is collected between the piston 10 and the surrounding structural elements and pushed out of the area 42 by the movement of the piston towards the head 22 or in the direction of the arrow 45 shown in FIG. 6.

While the piston 10 is at the bottom of its stroke in FIG. 5, the piston 10 has moved to the middle of its stroke in FIG. 6 as the end 33 of the pump section 29 of the piston 10 approaches the head 22 or housing structural element (see the arrow 45). As shown in FIG. 6, fluid is being pushed out of the first pump area or chamber 42 and into the passageway 43 (see the arrow 46). This action displaces fluid disposed in the passageway 43 and causes it to flow around the proximal section 28 and transition section 31 of the piston 10, or through the second chamber 44 as shown in FIG. 6. It will also be noted that the flat or machined area 13 of the piston 10 has been rotated thereby also causing fluid flow in the direction of the arrow 46 through the passageway 43 and towards the second chamber or area 44.

While FIG. 6 shows the piston 10 in the middle of its upstroke, FIG. 7 shows the piston 10 at the top or end of its stroke. The distal end 33 of the pump section 29 of the piston 10 is now closely spaced from the head or end cap 22. Fluid has been flushed out of the first chamber or area 42 (not shown in FIG. 7) and into the passageway 43 and second chamber or area 44 before passing out through the outlet 36. Now, a reciprocating movement back towards the position shown in FIG. 5 is commenced and illustrated in FIG. 8. As shown in FIG. 8, the piston 10 is moved in the direction of the arrow 47 which causes the transition section 31 to enter the second chamber or area 44 thereby causing fluid to be displaced through the outlet or in the direction of the arrow 48. No fluid is being pumped from the first chamber or area 42 at this point but, instead, the first chamber or area 42 is being loaded by fluid entering through the inlet and flowing into the chamber or area 42 in the direction of the arrow shown at 49.

In short, what is illustrated in FIGS. 5-8, and particularly FIG. 8 is the delayed dispensing of a portion of the fluid dispensed from the first chamber or area 42 during the motion illustrated by the sequence of FIGS. 5-7. Instead of all of the fluid in the first chamber or area 42 being dispensed at once as with conventional pumps, there is a lull in the dispense volume during the fill portion of the cycle illustrated in FIG. 8, but a portion of the fluid pumped from the first chamber or area 42 is pumped from the second chamber or area 44 during the fill portion of the of the cycle illustrated in FIG. 8 by the movement of the piston 10 in the direction of the arrow 47. In other words, a portion of the fluid being pumped is "saved" in the second chamber or area 44 and it is dispensed during the fill portion of the cycle as opposed to all of the fluid being dispensed during the dispense portion of the cycle. As a result, the flow is moderated and pulsing is avoided. Further, production is not compromised or reduced, but merely spread out over the entire cycle.

Figure 2:
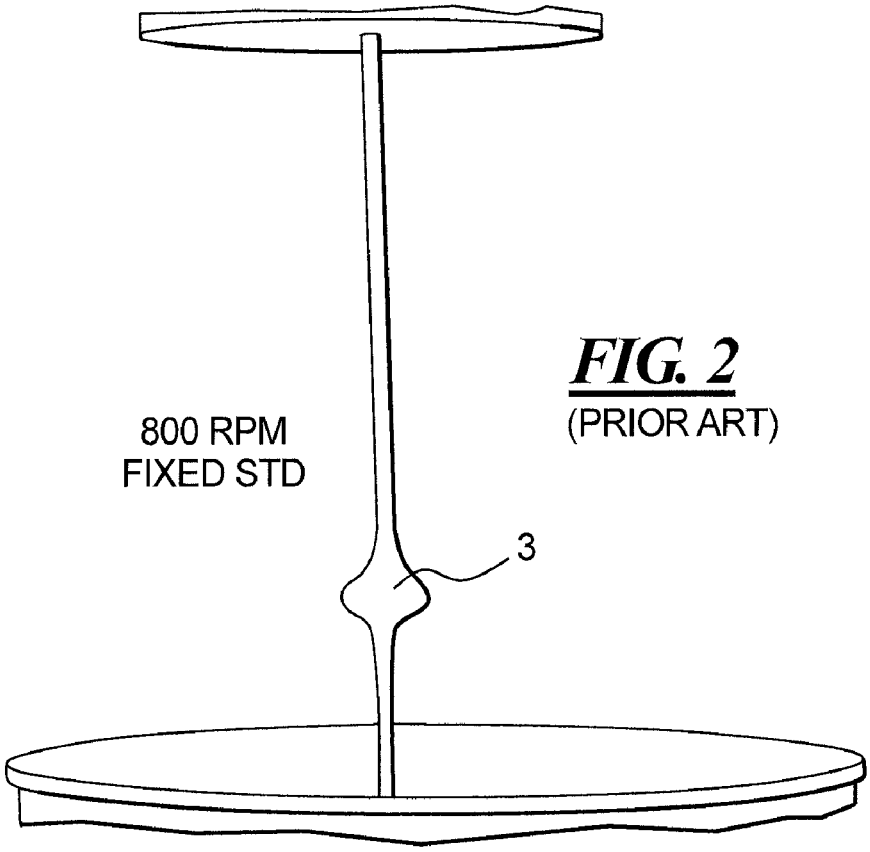
FIG. 2 (PRIOR ART)
FIG. 2 is a rendering from a photograph illustrating the pulsating dispense stream of the pump, the operation of which is graphically depicted in FIG. 1.
Figure 3:
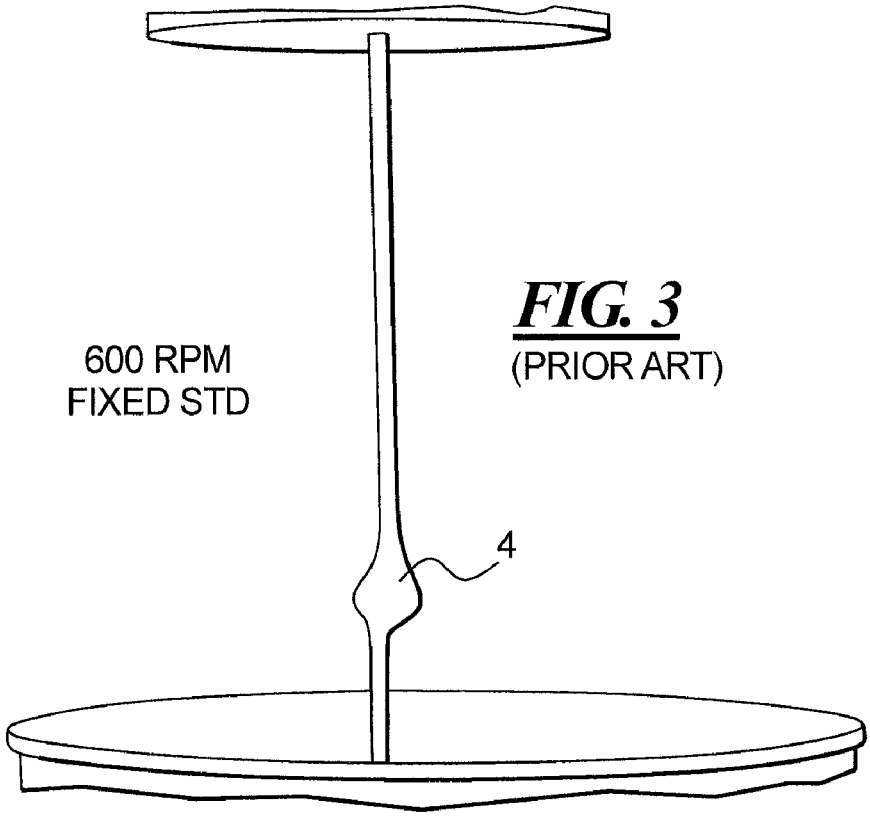
FIG. 3 (PRIOR ART)
FIG. 3 is another rendering of a photograph of an output stream of a prior art pump operated at a constant, but slower motor speed.
Figure 9:
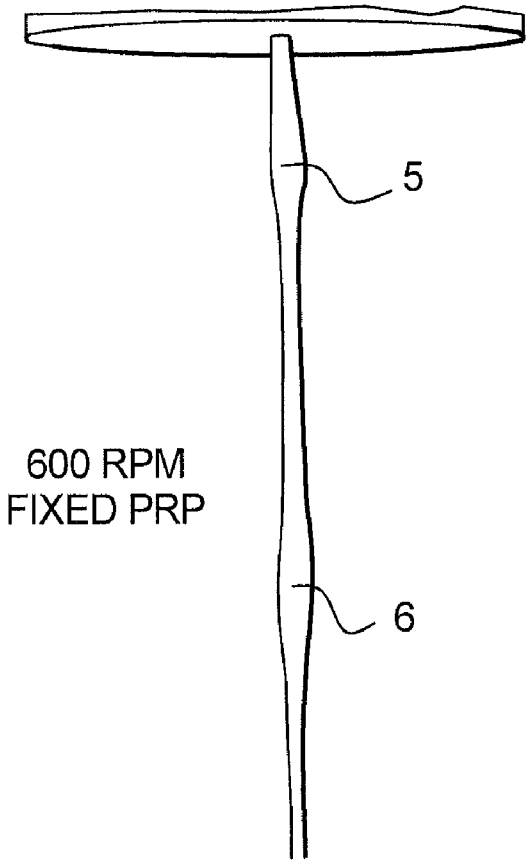
FIG. 9 is a rendering of an actual photograph of a dispense stream from the nutating pump illustrated in FIGS. 5-8 operating at a fixed motor speed of 600 rpm.
Figure 10:
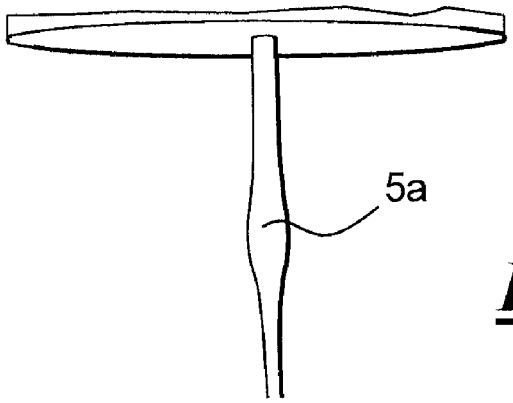
FIG. 10 is a rendering of an actual photograph of a dispense stream from the nutating pump illustrated in FIGS. 5-8 operating at a fixed motor speed of 800 rpm.
Figure 11:
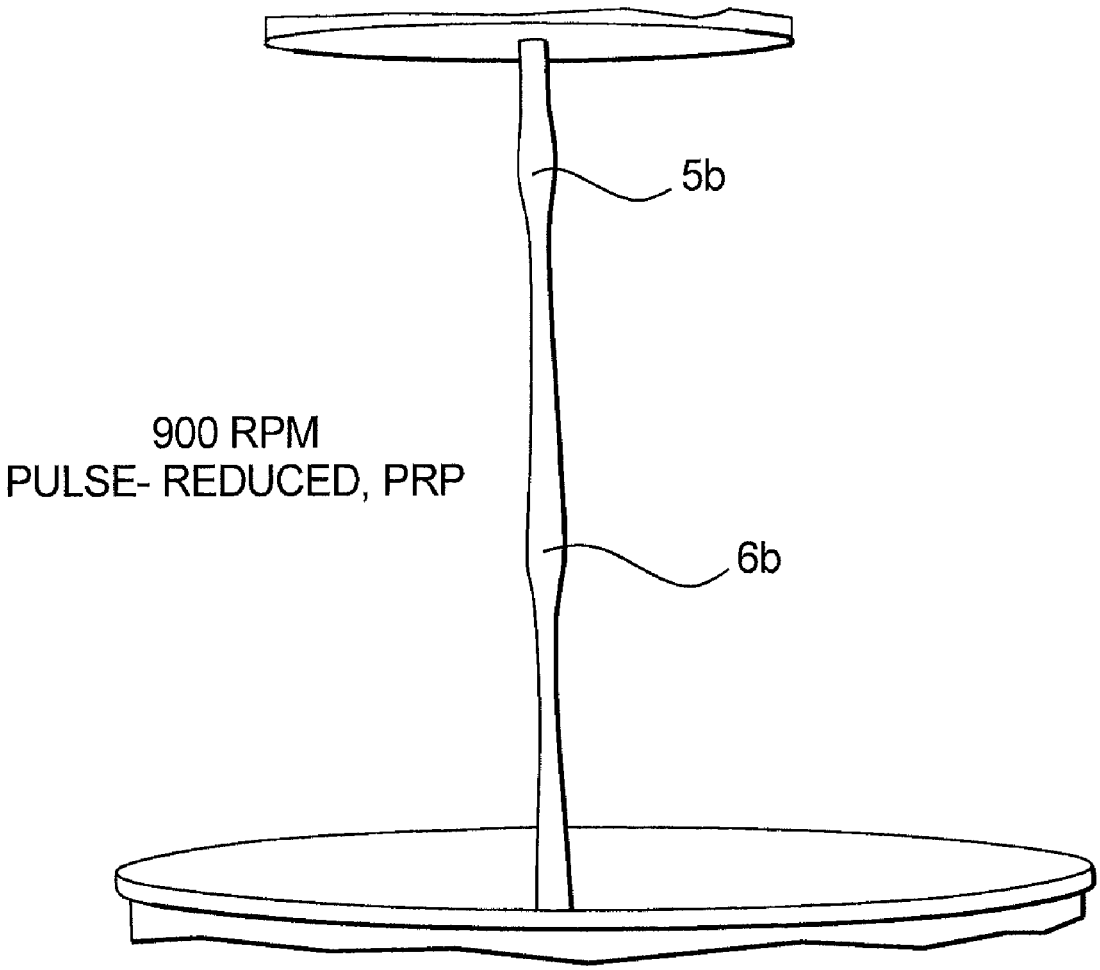
FIG. 11 is another rendering of a digital photograph of an output stream from the pump illustrated in FIGS. 5-8 but operating at an average motor speed of 900 rpm and using a fixed pulse-reduced dispense scheme.

Turning to FIGS. 9-11 renderings of actual dispense flows from a pump may in accordance with FIGS. 5-8 are illustrated. In FIG. 9, the pump is operated at a fixed motor speed of 600 rpm. As shown in FIG. 9, only minor increases in flow shown at 5 and 6 can be seen and no serious pulsations like those shown at 3 and 4 in FIGS. 2 and 3 are evident. Increasing the motor speed to 800 rpm results in little change in the pulsation shown at 5*a* in FIG. 10. Thus, with a pump constructed in accordance with FIGS. 5-8, the average speed can be increased from 600 rpm to 800 rpm with little or no increase in pulsation size. Further, the speed can be increased even more to 900 while maintaining little or no increase in pulsation size as shown at 5*b* and 6*b* in FIG. 11 if an additional pulse reduction control scheme is implemented that will be discussed below in connection with FIG. 14.

Figure 12:
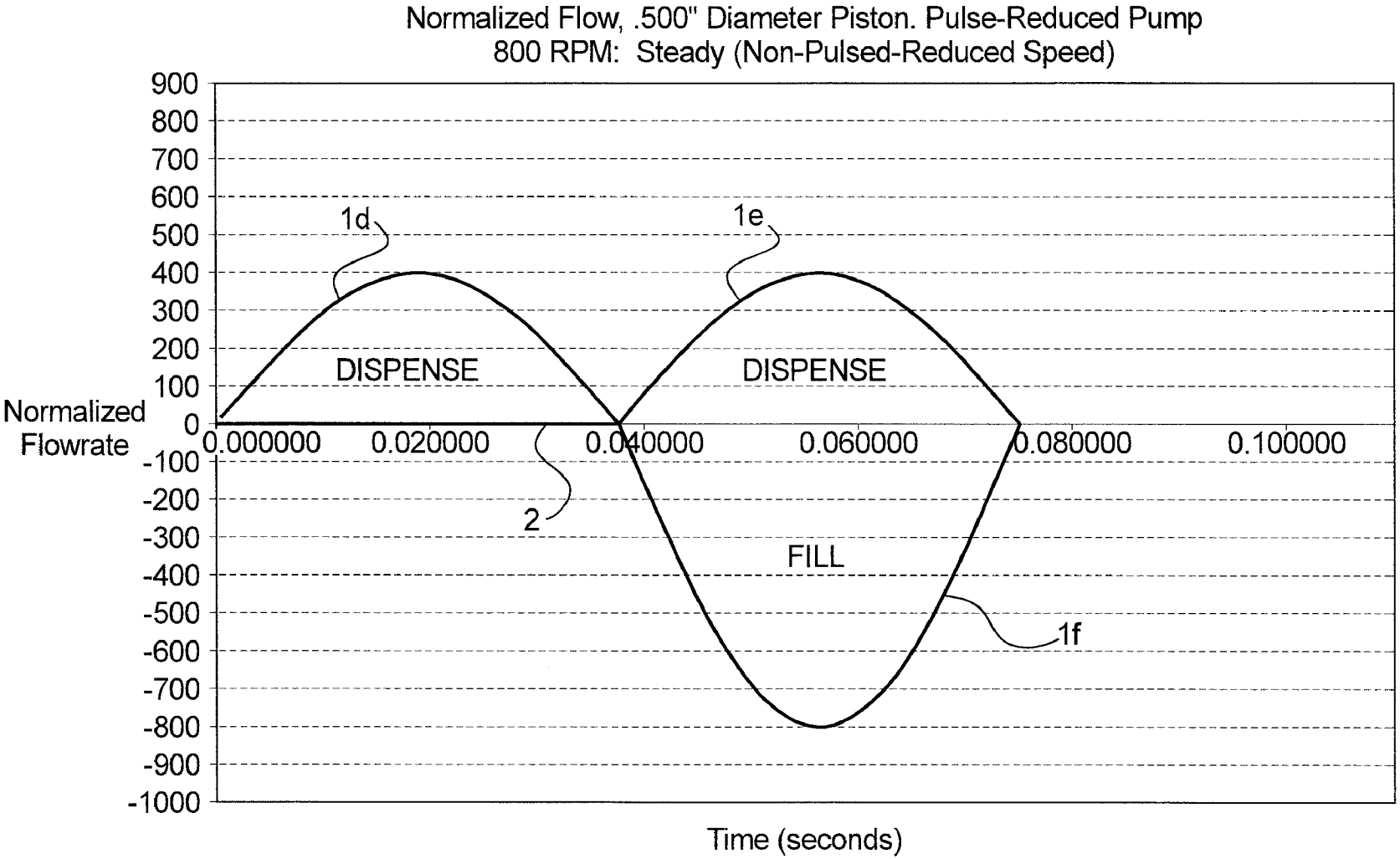
FIG. 12 graphically illustrates a dispense profile for a disclosed pump operating at a steady motor speed of 800 rpm to provide two modified dispense profiles, one of which occurs contemporaneously with the fill portion of the cycle.

Turning to FIG. 12, a dispense profile is shown for a pump constructed in accordance with FIGS. 5-8 and operating at a constant motor speed of 800 rpm. Two dispense portions are shown at 1*d* and 1*e* and a fill portion of the profile is shown at 1*f*. Only a slight break in dispensing occurs at the beginning of the fill portion of the cycle and moderated dispense flows are shown by the curves 1*d*, 1*e*. FIG. 12 is a graphical representation of the flow illustrated by FIG. 10 which, again, is a rendering of a digital photograph of an actual pump in operation.

Figure 4:
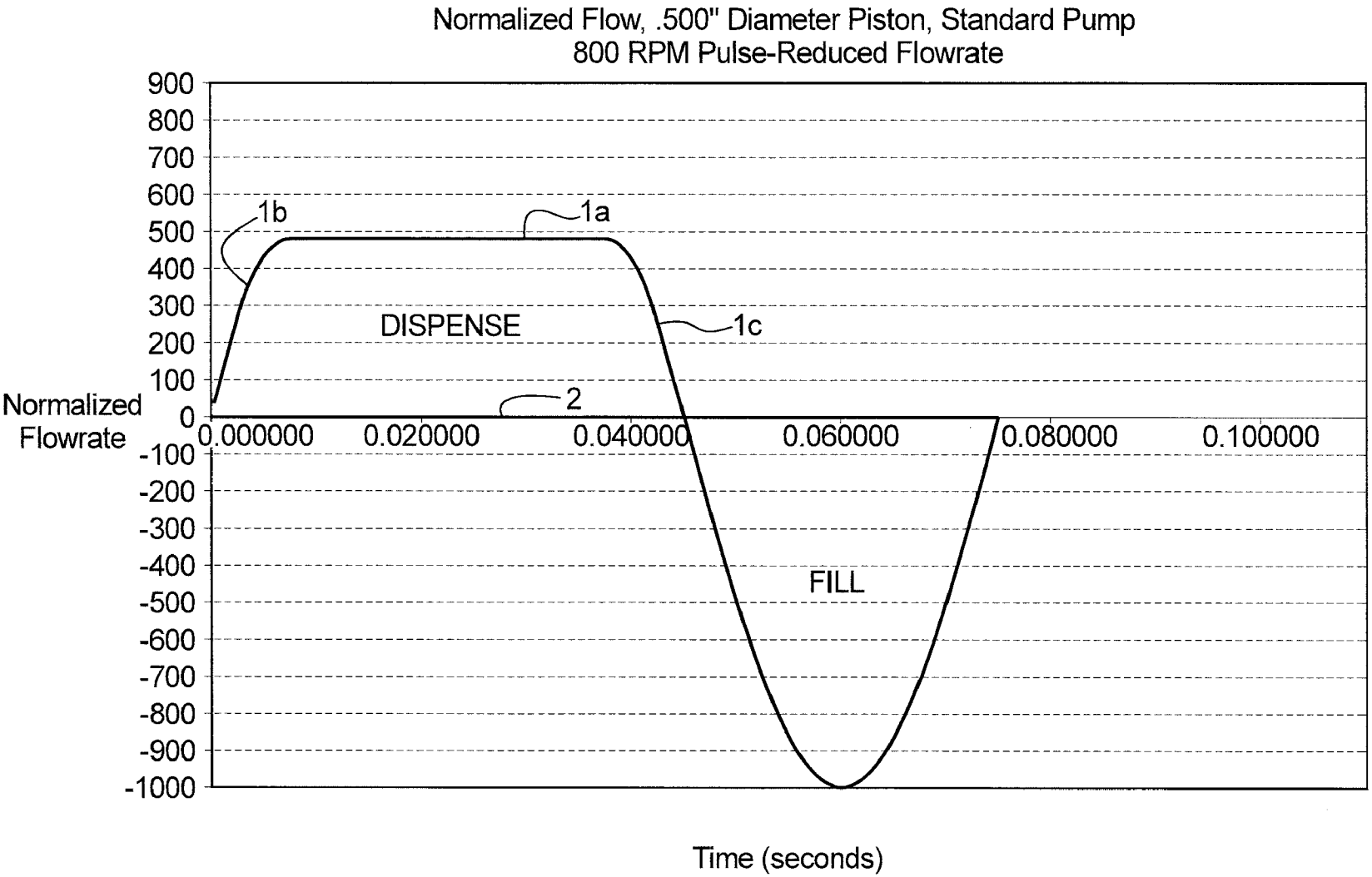
FIG. 4 (PRIOR ART)
FIG. 4 graphically illustrates a dispense and fill cycle for a prior art nutating pump operated at variable speeds to reduce pulsing.
Figure 13:
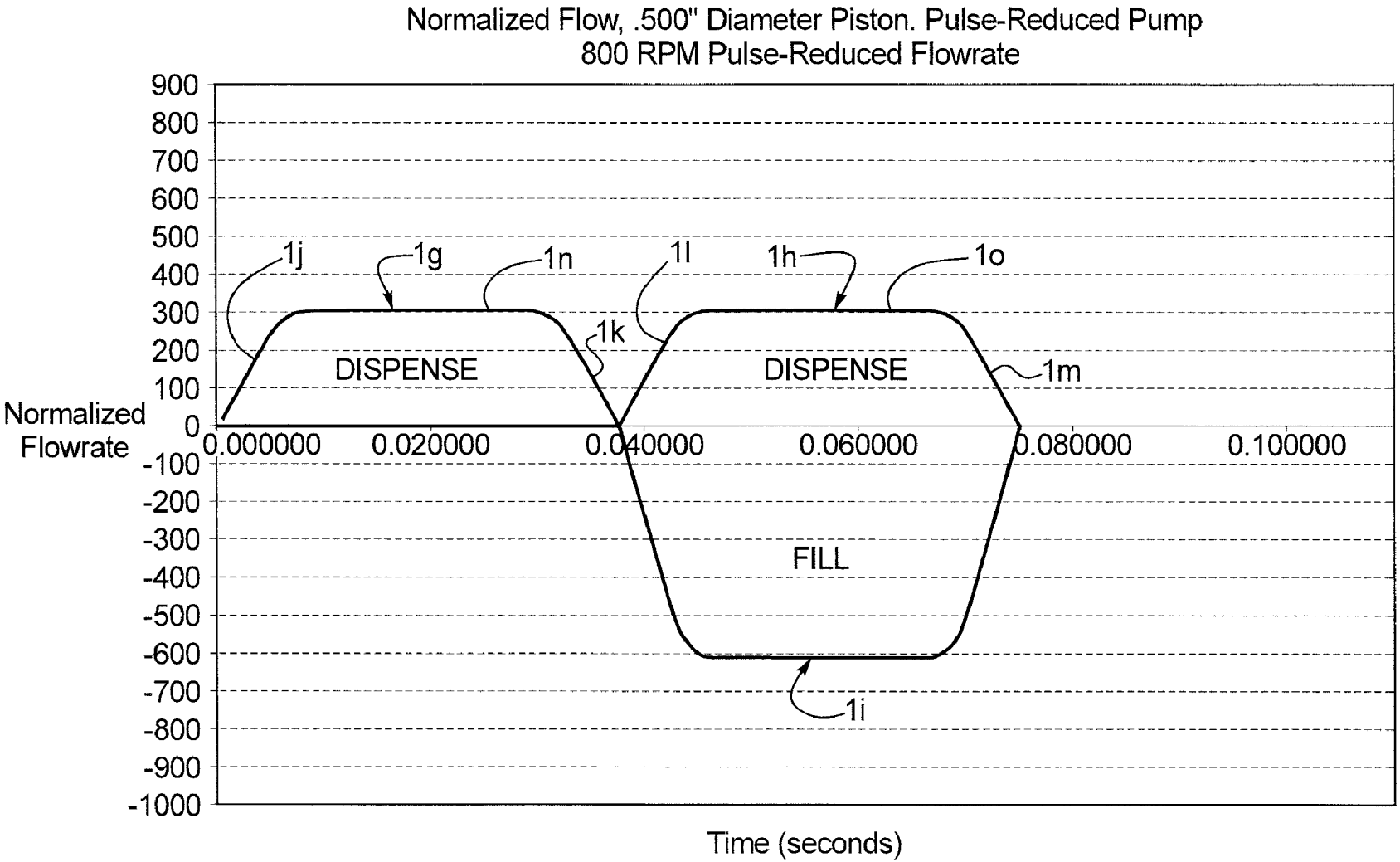
FIG. 13 graphically illustrates a dispense profile for a disclosed pump operating at an average motor speed at 800 rpm but with the motor speed varying to modify both dispense profiles, one of which occurs contemporaneously with the fill portion of the cycle.

Turning to FIG. 13, two dispense portions of the cycle are shown at 1*g*, 1*h* and the fill portion of the cycle is shown at 1*i*. Like the scheme implemented in FIG. 4 above, the motor speed is varied to reduce the peak output flow rate by 25% from that shown in FIG. 12 by reducing the speed in the middle of the dispense cycles 1*g*, 1*h* and increasing the motor speed towards the beginning and end of each cycle 1*g*, 1*h*. The result is an increase in slope of the curves at the beginning and end of each cycles as shown at 1*j*-1*m* and a flattening of the dispense profiles as shown at 1*n*, 1*o*. This increase and decrease in the motor speed during the dispense, cycle shown at 1*h* also results in an analogous flattened and widened profile for the fill cycle 1*i*.

Figure 14:
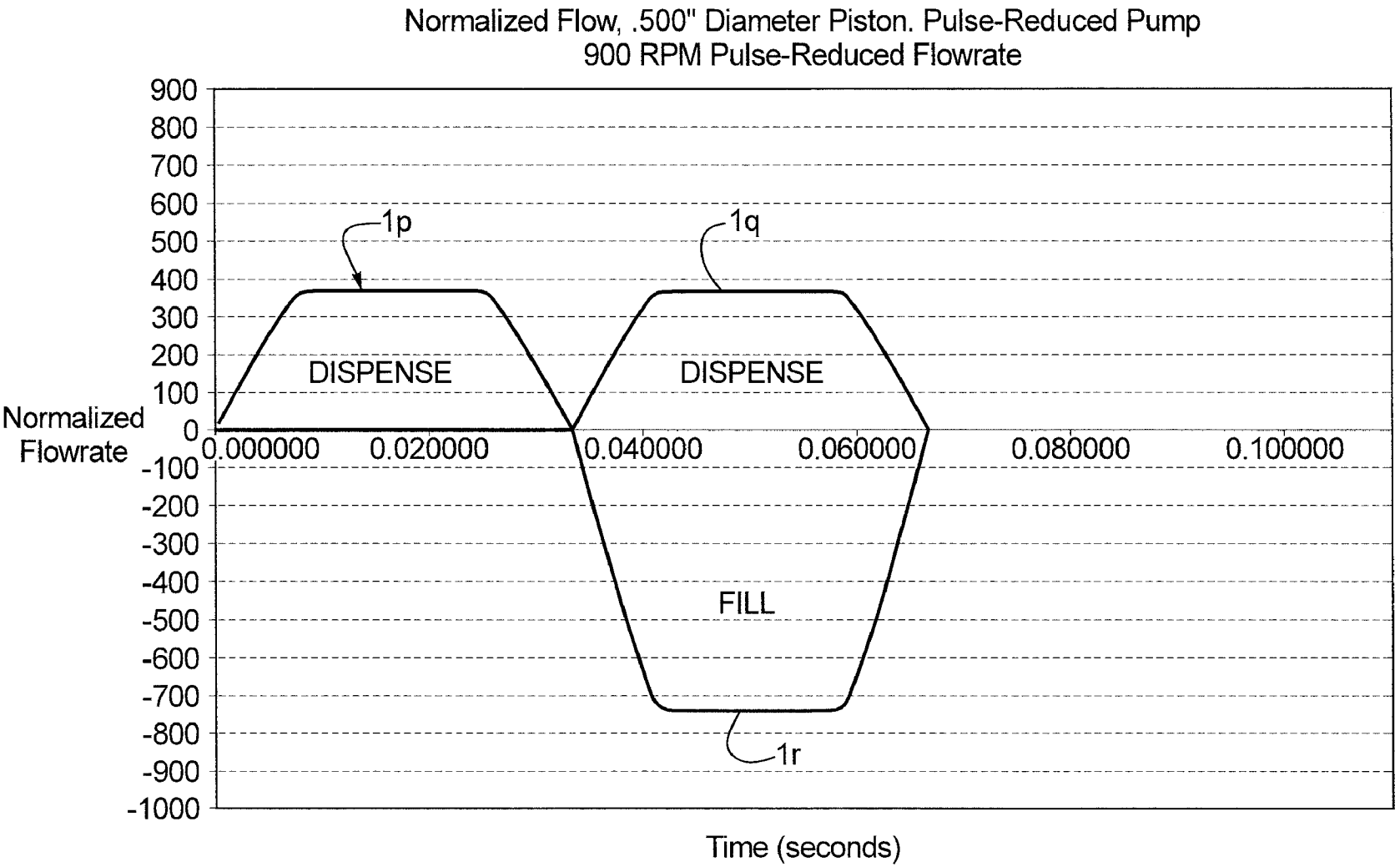
FIG. 14 graphically illustrates a dispense profile for a disclosed pump operating at an average motor speed at 900 rpm but with the motor speed varying to modify both dispense profiles, one of which occurs contemporaneously with the fill portion of the cycle.

Turning to FIG. 14, similar dual dispense cycles 1*p* and 1*q* are shown along with a fill cycle 1*r*. However, in FIG. 14, the average motor speed has been increased to 900 rpm while adopting the same pulse-reduction motor speed variations described for FIG. 13. In short, the motor speed is increased at the beginning and end of each dispense cycle 1*p* and 1*q* and the motor speed during the flat portions of cycles 1*p*, 1*q* is reduced. The fill cycle 1*r* occurs simultaneously with the dispense cycle 1*q*. In terms of referring to the overall action of the piston 10, the dispense cycle shown at 1*d*, 1*e*, 1*g*, 1*h*, 1*p* and 1*q* are, in fact, half-cycles of the complete piston movement illustrated in FIGS. 5-8.

Figure 15:
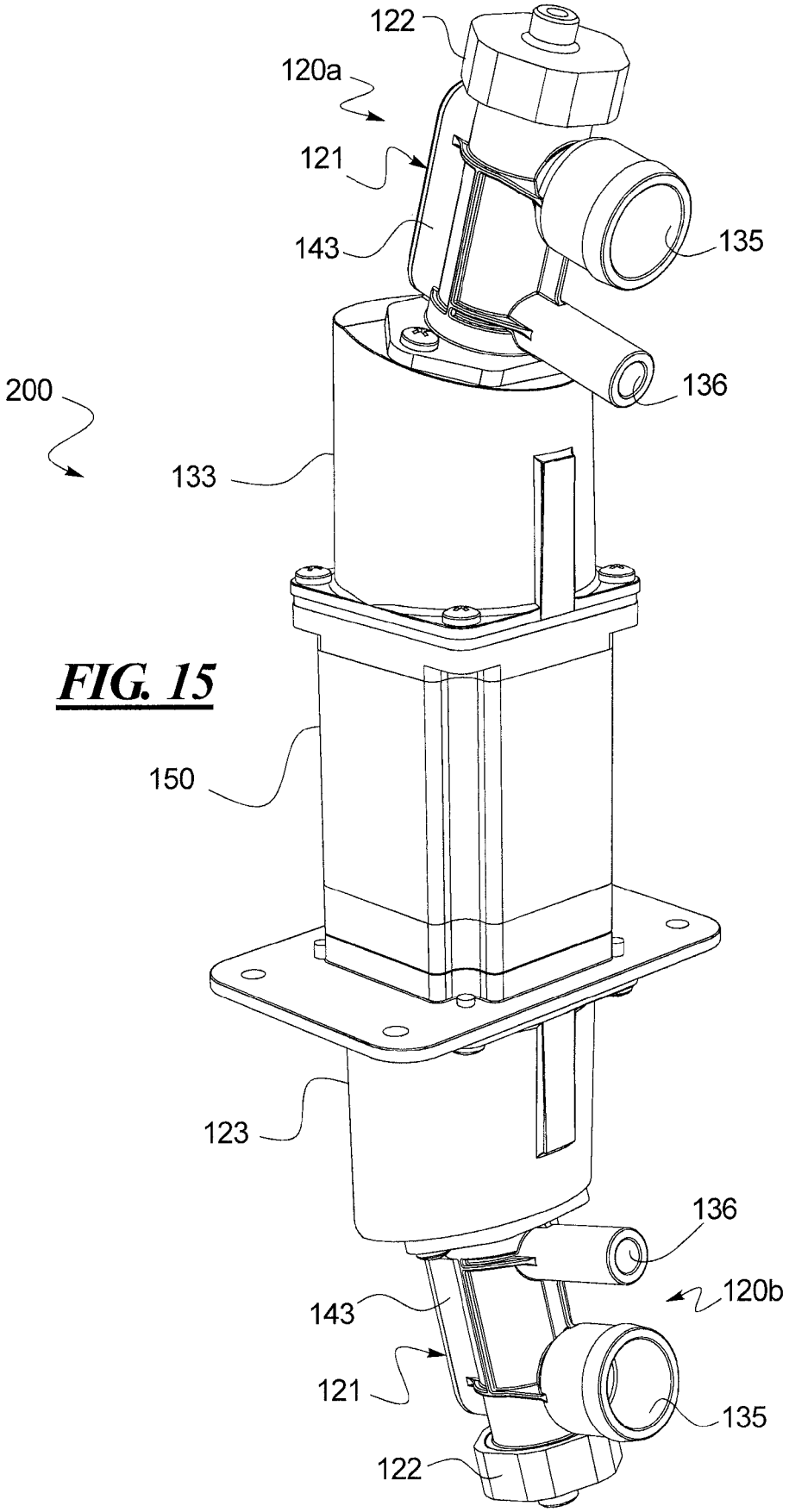
FIG. 15 is a perspective view of a dual nutating pump assembly providing four pump chambers and driven by a single motor in accordance with this disclosure.
Figure 16:
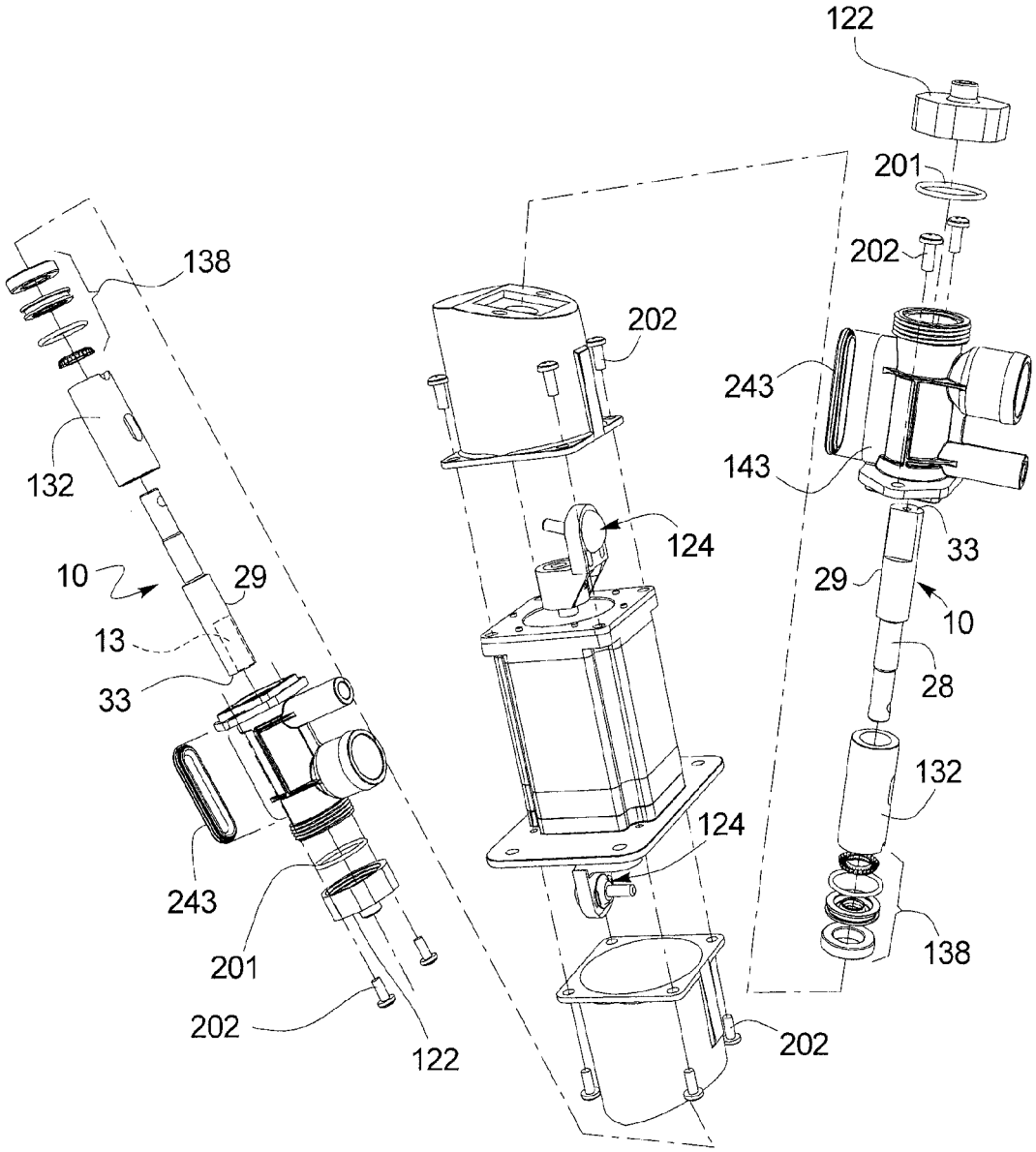
FIG. 16 is an exploded view of the assembly illustrated in FIG. 15.
Figure 17:
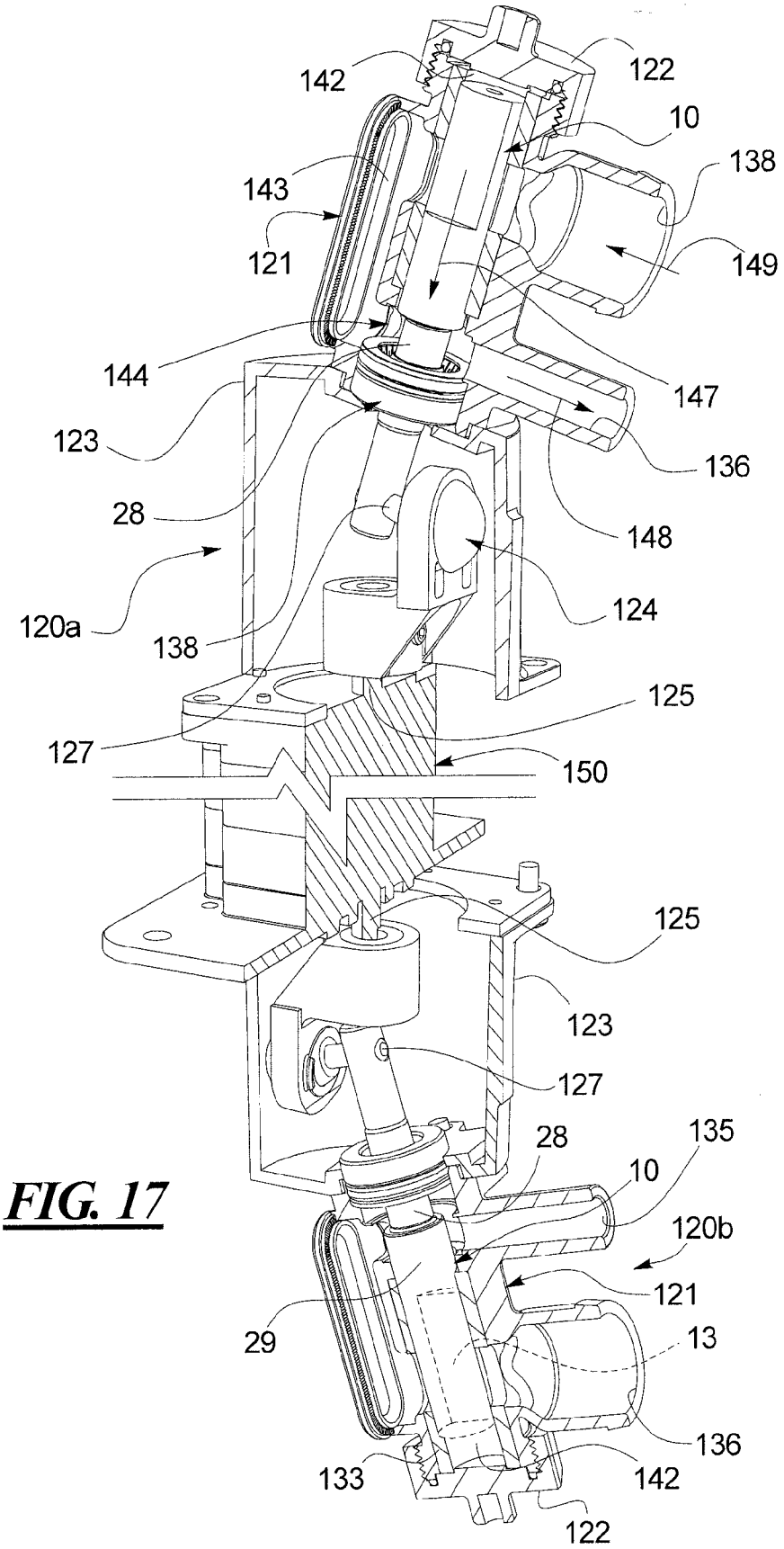
FIG. 17 is a sectional view of the assembly illustrated in FIGS. 15-16.

Turning to FIGS. 15-17, a dual or quad chamber pump system 200 is illustrated. Each pump 120*a*, 120*b*, operates in the same manner described above for the pump 20 illustrated in FIGS. 5-8. The pump system 200 includes a motor 150 disposed between like intermediate housing structures 123 and pump housing structures 121. Each pump housing 121 includes a passageway 143 that extends outside of the housing 121. The inlets 135 is in general alignment, or on the same size of the housing 21*b*, as their respective outlets 136 for each pump 120*a*, 120*b* but, the reader will recognize that the upper and lower pumps 120*a*, 120*b* are 90° out of phase from one another. That is, the upper inlet and outlet 135, 136 and lower inlet and outlet 135, 136 are at about right angles with respect to each other. Each housing 121 includes an end cap 122.

Turning to FIGS. 16-17, each piston 10 includes a machined or flat section 13 and the pump section 29 includes a distal end 33. The first chamber is shown at 142 at the bottom of FIG. 17. The proximal section 28 of each piston 10 has a reduced diameter compared to that of the pump section 29. Movement of the piston 10 of the upper pump 120*a* in FIG. 17 in the direction of the arrow 147 results in displacement of fluid from the second chamber or area indicated at 144 through the outlet 136 as indicated by the arrow 148 while the first chamber 142 is being with fluid passing through the inlet 135 as indicated by the arrow. Thus, the position of the pump 120*a* piston 10 in FIG. 17 is analogous to the position of the position of the piston 10 and pump 20 of FIG. 8. Similarly, the position of the lower pump 120*b* in FIG. 17 is analogous to the position of the pump 20 of FIG. 5 as the second chamber or area 144 has been emptied by the pump section 29.

Additional features illustrated in FIGS. 15-17 include the seal assemblies 138, links 127 coupling members 124 and the motor drive shafts 125 which are shown schematically. As shown in FIG. 16, the passageways 143 in the housings 121 may be covered by a cap or cover 243. In some embodiments, the pistons 10 are accommodated within sleeves or seal members 132 which prevent fluid from circumventing the pathway between the inlet 135 and outlet 136 through the passageway 143 as discussed above in connection with FIGS. 5-8. O-rings or seal members to a one may be disposed inside the threaded caps 122 and conventional fasteners 202 may be used to secure the pump housings 121 to the intermediate housings 123 and the intermediate housings 123 to the motor 150.

Figure 18:
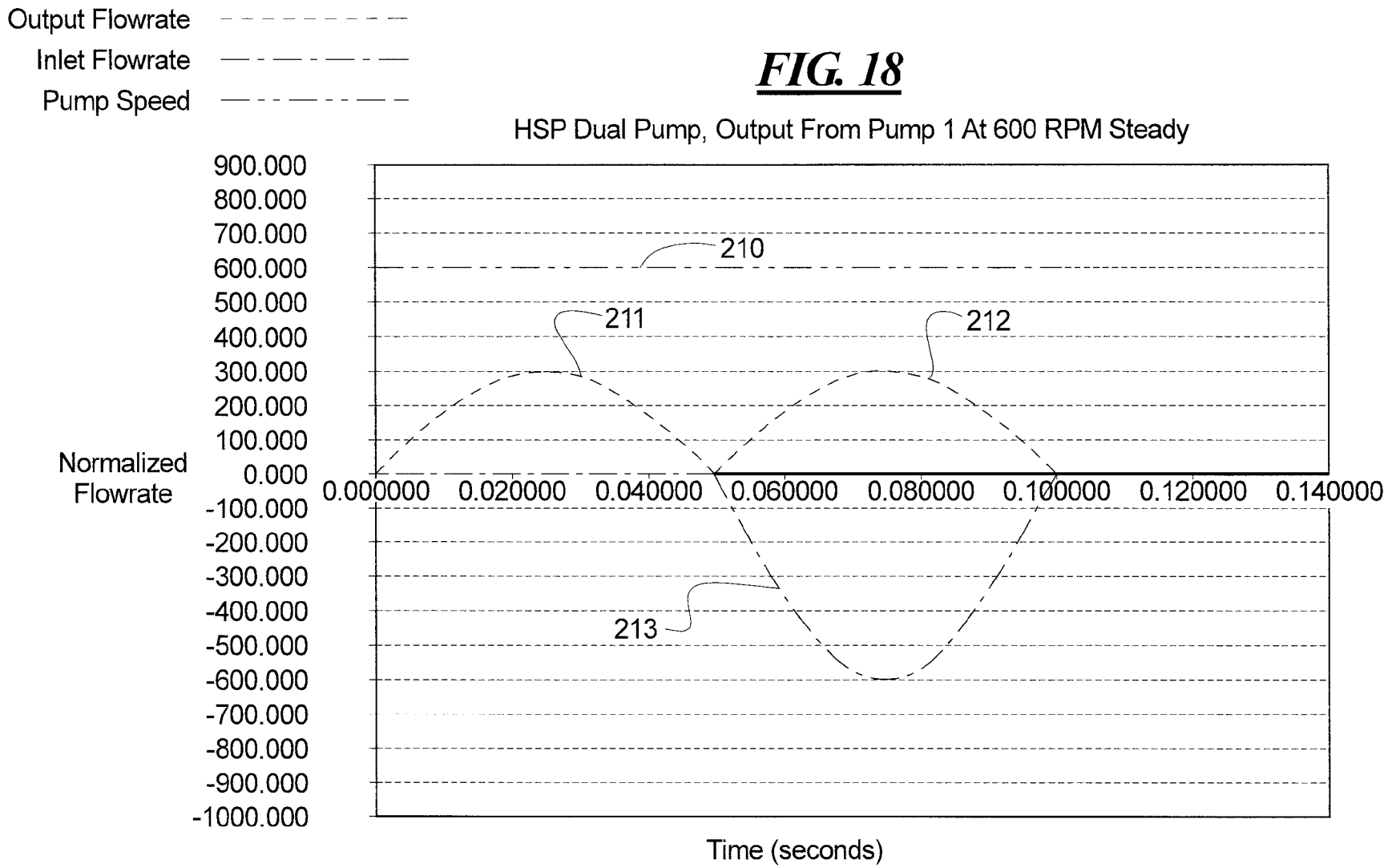
FIG. 18 graphically illustrates a dispense profile for one of the disclosed pumps illustrated in FIGS. 15-17 operating at a fixed motor speed of 600 rpm.
Figure 19:
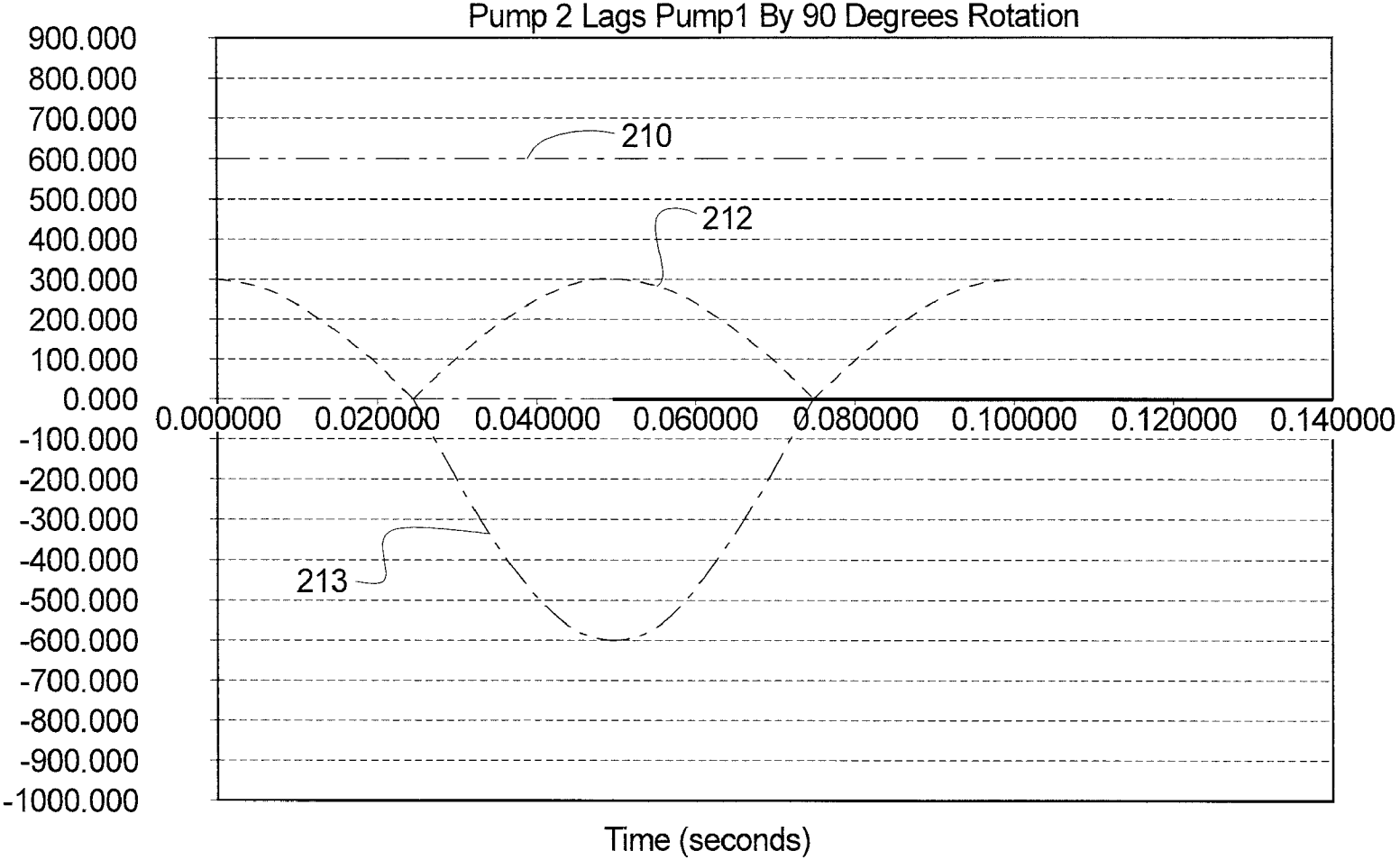
FIG. 19 graphically illustrates a dispense profile for the other pump illustrated in FIGS. 15-17 operating at a fixed motor speed of 600 rpm and 90° out of phase from the pump graphically illustrated in FIG. 17.
Figure 20:
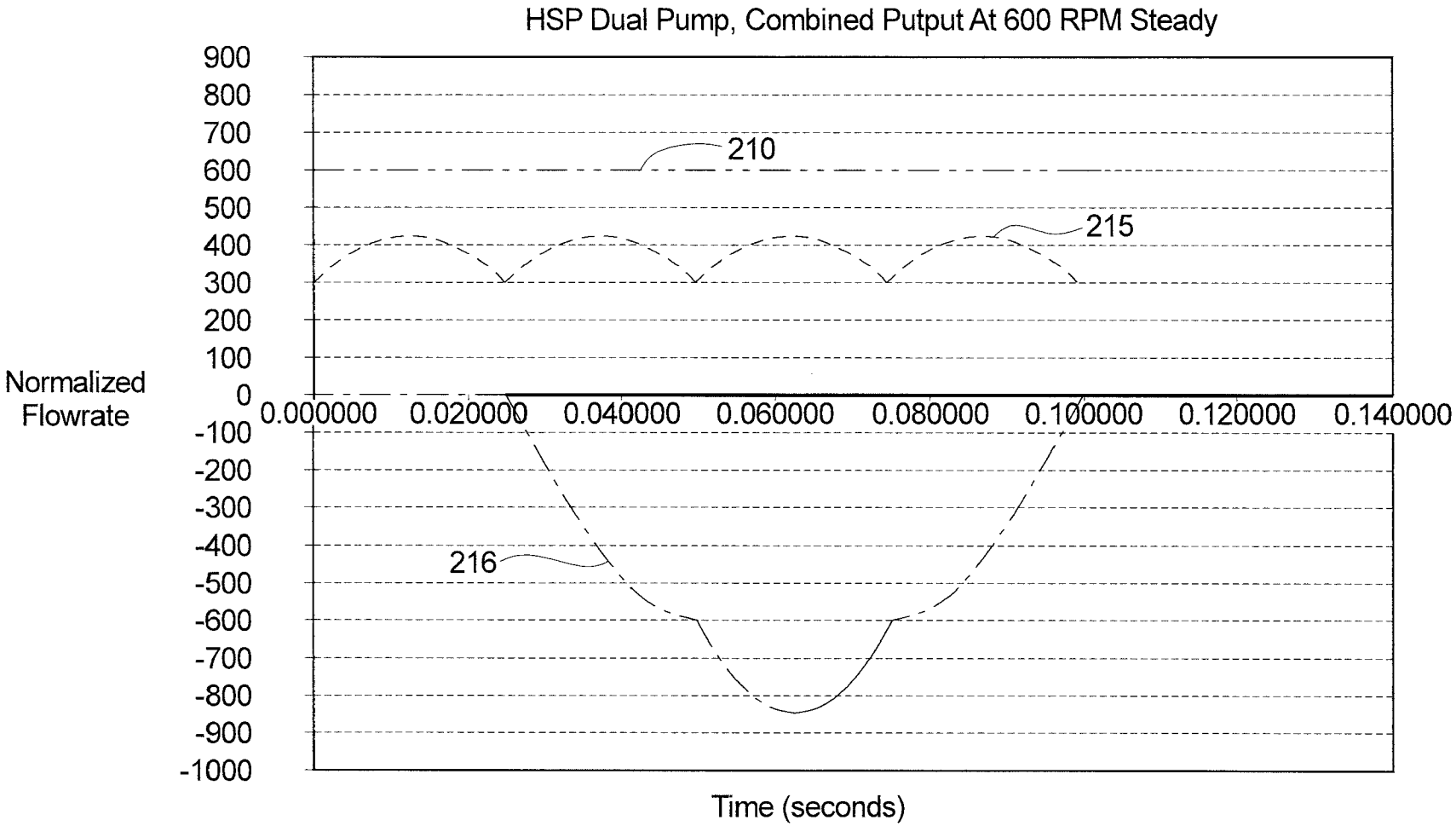
FIG. 20 graphically illustrates the cumulative dispense profile of the dual pump/quad chamber system disclosed herein.
Figure 21:
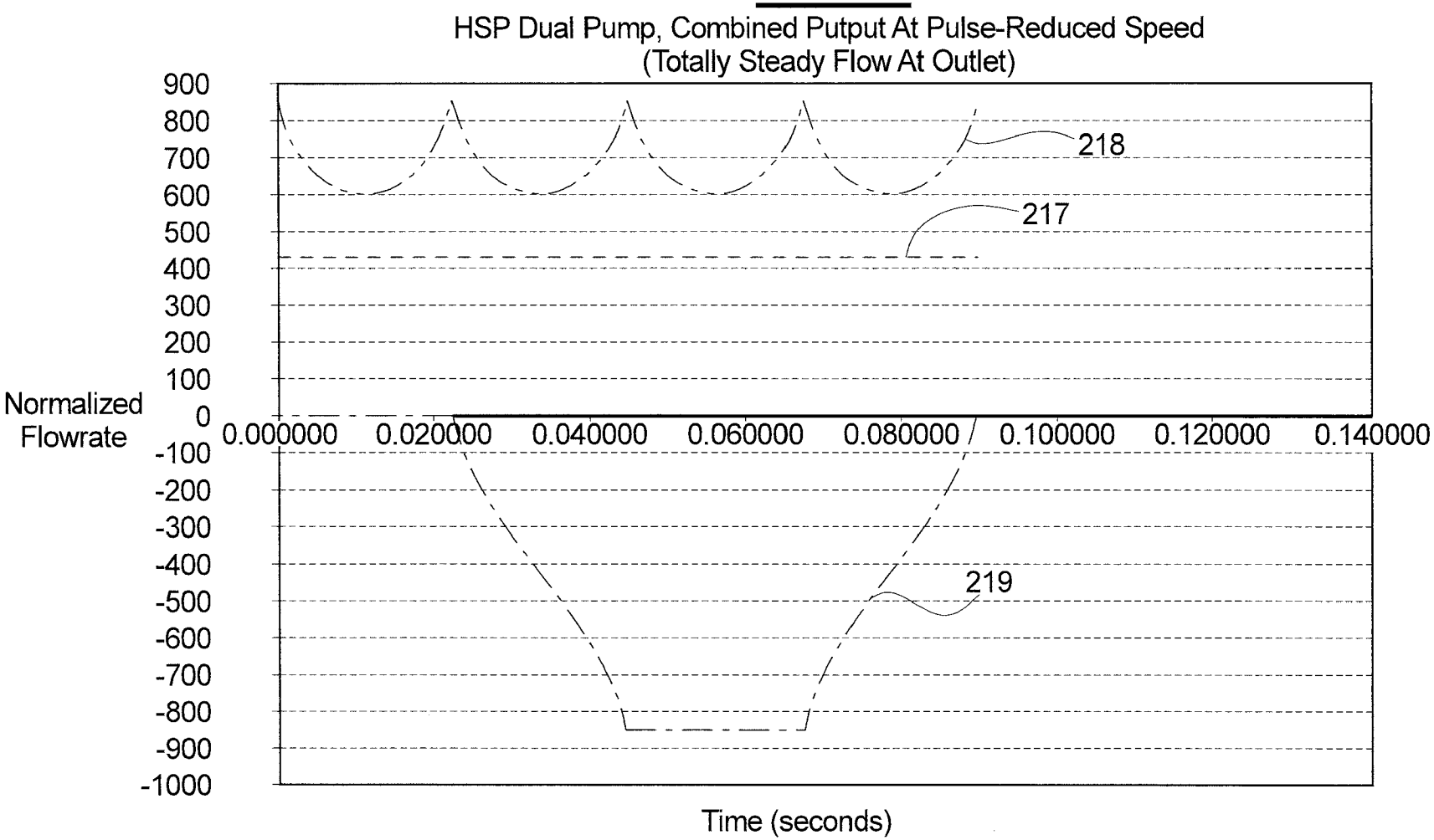
FIG. 21 graphically illustrates of the cumulative dispense profile of the dual pump/quad chamber system disclosed herein using pulse-reduced motor speeds to provide a constant output flow.

Turning to FIGS. 18-21, the operation of the dual pump 200 will be illustrated graphically. The operation of a single pump 120*a* or 120*b* is illustrated in FIG. 18. The pump is operated at a constant motor speed indicated by the horizontal line to 10. The output curve is for the pump chamber 142 shown at 211 and at 212 for the pump chamber 144. The intake curve is shown at 213. As the reader will recall, the second pump chamber 144 is dispensing fluid is the first pump chamber 142 is in-taking fluid. FIG. 19 graphically illustrates the other of the two pumps 120*a*, 120*b* that is out of phase with the pump illustrated in FIG. 18. Because a common motor 150 is utilized, the motor speed is identical. The output curve 212 for the second chamber 144 and the input curve 213 for the pump chamber 142 are 90° out of phase from the graphical illustration of FIG. 18. FIG. 20 is a combination of the data from FIGS. 18 to 19 with a constant motor speed of 600 rpm is indicated by the line 210 and a relatively smooth combined output curve 215 and combined input curve 216. Applying pulse modification techniques that incorporate modifying the speed of the motor 150, FIG. 21 illustrates the relatively constant pump output curve 217 may be obtained by periodically decreasing and increasing the motor speed is indicated by the curve 218. The intake curve to 219 is also similarly modulated.

As a result, the employment of two nutating pumps 120*a*, 120*b* with separate motors or a single motor 150 and relatively straightforward motor speed control can result in a constant or near constant output flow thereby increasing accuracy, reducing the chances of splashing, sputtering, etc.

While only certain embodiments have been set forth, alternative embodiments and various modifications will be apparent from the above description to those skilled in the art. These and other alternatives are considered to fall within the spirit and scope of this disclosure.

What is claimed is:

1. A pump comprising:

a pair of piston pumps operated about 90° out of phase, each pump comprising a rotating and reciprocating piston disposed in a pump housing, each housing comprising an inlet, an outlet, an interior and a seal, each piston comprising a proximal section coupled to a pump section at a transition section, the proximal section having a first maximum outer diameter, the pump section having a second maximum outer diameter that is greater than the first maximum outer diameter, each pump section comprising a distal recessed section disposed opposite the pump section from the transition section, the pump section extending between the transition section and a distal end of the piston, each housing, piston and seal defining two pump chambers each of which includes a first chamber defined by the distal recessed section and distal end of the pump section of the piston and the housing, and a second chamber defined by the transition section and proximal section of the piston and the housing, wherein each pair of first and second pump chambers being isolated from each other by frictional engagement between the pump section of the piston and the seal, but the first and second pump chambers being in communication with each other via a passageway, and wherein the proximal ends of each piston are linked to a motor so that the pistons are about 90° out of phase with respect to each other.

2. The pump of claim 1 wherein each passageway bypasses the seal to provide communication between the first and second chambers.

3. The pump of claim 1 wherein the seal of each housing further comprises a seal sleeve that includes a first opening providing communication between the inlet and the first chamber and a second opening providing communication between the first chamber and the passageway.

4. The pump of claim 3 wherein each seal sleeve comprises a distal end that also defines the first chamber with the housing and a proximal end that defines the second chamber with the housing.

5. The pump of claim 4 wherein the distal end of each seal sleeve abuts an end cap which also defines the first chamber with the sleeve.

6. The pump of claim 1 wherein the proximal section of each piston passes through a proximal seal that also defines the second pump chamber with the housing.

7. The pump system of claim 1 further comprising a controller operatively coupled to the motor, the controller generating a plurality of output signals including at least one signal to vary the speed of the motor.

8. The pump of claim 1 wherein the first maximum outer diameter of each piston is about 0.707 times the second maximum outer diameter of each piston.

9. A method of pumping fluid, the method comprising:

providing the two pumps as recited in claim 1, pumping fluid from each first chamber to each outlet and loading fluid into the each second chamber by rotating and axially moving each piston so the distal end of the pump section moves toward and into the first chamber and the first transition section exits the second chamber, pumping fluid from each second chamber and loading fluid into each first chamber by continuing to rotate each piston and axially moving each piston so each first transition section enters each second chamber and each distal end of each pump section exits each first chamber.

10. A dual pump comprising:

a pair of rotating and reciprocating pistons disposed in separate pump housings but coupled to a common motor, wherein the pistons are about 90° out of phase from one another, each housing comprising an inlet and an outlet, each inlet and outlet each being in fluid communication with an interior of the housing, each piston comprising a proximal section coupled to a pump section at a transition section, each proximal section being linked to the motor, each proximal section having a first maximum outer diameter, each pump section having a second maximum outer diameter that is greater than the first maximum outer diameter, each pump section comprising a distal recessed section disposed opposite the pump section from transition section, each pump section extending between the transition section and a distal end, at least a portion of each pump section disposed between the distal recessed section and the first transition section being at least partially and frictionally received in a middle seal, at least a portion of each proximal section being frictionally received in a proximal seal, each housing and each piston defining two pump chambers including a first chamber defined by the distal recessed section and distal end of the piston and the housing, and a second chamber defined by the transition section and proximal section of the piston, the proximal seal and the housing.

11. The dual pump of claim 10 wherein each first maximum outer diameter of each piston is about 0.707 times the second maximum outer diameter of each piston.

12. The dual pump of claim 10 further comprising a controller operatively coupled to the motor, the controller generating a plurality of output signals including at least one signal to vary the speed of the motor.

13. A method of pumping fluid, the method comprising:

providing the two pumps as recited in claim 10, pumping fluid from each first chamber to each outlet and loading fluid into the each second chamber by rotating and axially moving each piston so the distal end of the pump section moves toward and into the first chamber and the first transition section exits the second chamber, pumping fluid from each second chamber and loading fluid into each first chamber by continuing to rotate each piston and axially moving each piston so each first transition section enters each second chamber and each distal end of each pump section exits each first chamber.

14. The method of claim 13 wherein the pistons are about 90° out of phase from each other.

* * * * *